US007104096B2

(12) United States Patent
Comunello

(10) Patent No.: US 7,104,096 B2
(45) Date of Patent: Sep. 12, 2006

(54) SPRING LATCH LOCK

(75) Inventor: Vittorio Comunello, Rosà (IT)

(73) Assignee: Fratelli Comunello S.p.A., Rosa (IT)

( * ) Notice: Subject to any disclaimer, the term of this patent is extended or adjusted under 35 U.S.C. 154(b) by 0 days.

(21) Appl. No.: 10/503,719

(22) PCT Filed: Feb. 22, 2002

(86) PCT No.: PCT/IT02/00108

§ 371 (c)(1),
(2), (4) Date: Feb. 2, 2005

(87) PCT Pub. No.: WO03/071062

PCT Pub. Date: Aug. 28, 2003

(65) Prior Publication Data

US 2005/0126234 A1 Jun. 16, 2005

(51) Int. Cl.
*E05B 63/06* (2006.01)

(52) U.S. Cl. ..... 70/107; 70/461; 70/462; 292/1.5; 292/244; 292/DIG. 60

(58) Field of Classification Search ..... 70/107, 70/461, 462; 292/1.5, 337, 244, 245, DIG. 60
See application file for complete search history.

(56) References Cited

U.S. PATENT DOCUMENTS

| | | | | | |
|---|---|---|---|---|---|
| 40,875 | A * | 12/1863 | Williams | 292/169.17 |
| 57,930 | A * | 9/1866 | Lee | 292/244 |
| 671,792 | A * | 4/1901 | Comber | 292/2 |
| 1,672,076 | A * | 6/1928 | Munson | 70/461 |
| 1,974,769 | A * | 9/1934 | Elliott | 70/107 |
| 2,068,737 | A * | 1/1937 | De Vries | 292/244 |
| 4,066,284 | A * | 1/1978 | Ikemura | 292/62 |
| 4,662,666 | A * | 5/1987 | Wimmer | 292/1.5 |
| 4,796,931 | A * | 1/1989 | Heid | 292/92 |
| 4,852,918 | A * | 8/1989 | Allen | 292/169 |
| 4,875,725 | A * | 10/1989 | Marks | 292/244 |
| 5,489,128 | A * | 2/1996 | Florian | 292/1.5 |
| 6,684,669 | B1 * | 2/2004 | Talpe | 70/107 |

FOREIGN PATENT DOCUMENTS

| | | |
|---|---|---|
| DE | 24463 | 12/1883 |
| DE | 102699 | 4/1899 |
| DE | 273393 | 4/1914 |
| DE | 25 26 217 | 12/1976 |
| FR | 2618832 | 2/1989 |
| FR | 2 761 722 | 10/1998 |

* cited by examiner

*Primary Examiner*—Lloyd A. Gall
(74) *Attorney, Agent, or Firm*—Browdy and Neimark, PLLC

(57) ABSTRACT

A lock (1, 30) having a box body (2) with a faceplate (3), a latch (4) co-operating with an elastic element (5) adapted to keep the latch normally protruding from the faceplate (3) and with a moving element (6) associated to a handle (M) to be actuated by the user and a mechanical adjustment unit (7) adapted to change the length of the portion (4*a*) of the latch (4) protruding from the faceplate (3). The mechanical adjustment unit (7) having a plurality of seats (8) made in the latch, (4), a cylindrical pin (9) adapted to be received in each of the seats (8) and adjustment apparatus (10) accessible from outside and acting on the pin (9) to constrain it in the corresponding seat (8) or release it therefrom.

11 Claims, 2 Drawing Sheets

SPRING LATCH LOCK

BACKGROUND OF THE INVENTION

1. Technical Field of the Invention

The present invention relates to an improved spring latch lock.

2. Prior Art

It is well known that spring latch locks are devices to close and open doors, main entrances, gates and the like, generally comprising a box body with a front plate and a sliding latch actuated by a handle.

Inside the box body there are the actuating mechanisms for the spring latch that can be reached and operated from outside through a handle which is inserted in a corresponding hole made on one or both sides of the box body. The locks are arranged hidden inside a corresponding housing made in the thickness of the door, entrance or gate, the actuating handle of the latch protruding from at least one side thereof.

Reliability of operation of the above mentioned locks is generally recognised as well as their functional limits with regard to the different applications for which said locks may be intended.

A first recognised limitation is the constructional form of the latch having a fixed length so that its portion protruding from the faceplate cannot be modified.

This involves that the same lock cannot be used for different applications, when each application requires a different protrusion of the latch from the corresponding faceplate.

Thus, for instance, the same lock cannot be indifferently applied to a door, a main entrance or a gate having different penetrations of the latch in the frame. The same happens for instance in rooms provided with doors identical to each other to which however different penetrations of the latch in the frame should be carried out whereby it is necessary to use locks with the same box body but having different performances with different latch protrusion.

Moreover identical locks but having different latch protrusions are not interchangeable.

In order to make easier closure of the door, main entrance or gate to which the lock is applied the protruding end of the latch has a bevel that during the closing operation is forced against the frame promoting the elastic return of the latch inside the box body.

When the closing operation is ended, the latch comes out automatically from the box body and is inserted into the rabbet of the frame.

This involves the further drawback that the same lock cannot be applied indifferently to door, entrances or gates having either right hand or left hand closures so that a lock provided with a right hand bevelled latch cannot be applied to doors with left hand closure and viceversa.

In order to overcome the above mentioned limitations, locks are made provided with adjusting means allowing to change the length of the latch protruding portion and to rotate the latch so that the bevel is always facing the frame irrespective of the fact that the lock is applied to a door, entrance or gate having either a right hand or left hand closure.

These locks, however, have the drawback that said adjustments are difficult to be carried out.

More particularly the locks having the possibility to change the orientation of the latch bevelled portion relative to the frame, show a greater constructional difficulty because the latch must be made in two coaxial parts that can be mutually blocked through screws, where the latch protruding portion can be turned relative to the part lodged inside the box body.

Another drawback consists in that, in order to change the latch protrusion, the lock must be taken out from its housing, the box body must be opened in order to act on the adjusting means to define the required protrusion of the latch.

After having carried out such an adjustment, the box body is again closed, the lock is again assembled and it is also necessary to check whether the length of the protruding portion meets the requirements.

If the length of the protruding portion is not satisfactory, the above mentioned operations should be repeated.

Therefore, it is clear that such an adjustment is a long and difficult operation. Moreover such an adjustment must be carried out by persons having at disposal proper tools and with specific professional skill.

OBJECT AND SUMMARY OF THE INVENTION

The present invention aims at overcoming all the above mentioned drawbacks. More particularly the first object of the invention is to provide a lock in which it is possible to adjust the length of the latch portion protruding from the lock and the orientation of its shaped end relative to the frame against which it rests, without taking out the lock from the housing of the door, entrance or gate to which it is coupled.

Another object is that said adjustments may be carried out without disassembling even a portion of the lock.

A last but not least object is that said adjustment does not require intervention of specialised workers.

Said objects are attained by a lock of the kind comprising:

- a box body;
- a faceplate associated to said box body;
- a latch co-operating with spring means adapted to keep it normally protruding from said faceplate and moving means associated to a handle that can be actuated by the user;
- a mechanical adjustment unit adapted to modify the length of the portion of said latch protruding from said faceplate, and is characterised in that said mechanical adjustment unit comprises:
- a plurality of seats made in the latch body;
- at least a contrast element adapted to be received in each of said seats; and
- adjustment means accessible from outside and acting on said at least a contrast element to constrain it in the corresponding seat or release it from the seat.

According to a preferred embodiment each seat consists of a crescent like recess receiving a corresponding contrast element consisting of a cylindrical pin having its longitudinal axis arranged transversally to the latch movement direction.

The seats made in the latch body are aligned according to two rectilinear directions parallel to each other and to the longitudinal axis of the latch but offset at 180° one to the other.

According to this embodiment, by rotating the latch of 180° around its longitudinal axis, its bevelled portion is oriented to the frame according to the rotation direction with which the door, entrance or gate is being closed.

Advantageously the lock of the invention makes easier the operations of adjustment and control and faster the setting up operations carried out at the building yard before the premises are delivered.

Again advantageously in view of the simplicity of the adjustment to be carried out, said adjustment may be effected event by unskilled workers with little experience.

BRIEF DESCRIPTION OF THE DRAWINGS

Said objects and advantages will be better understood by reading the following description of a preferred embodiment of the invention with reference to the accompanying sheets of drawings in which.

DETAILED DESCRIPTION OF THE PREFERRED EMBODIMENT OF THE INVENTION

Figure 1:
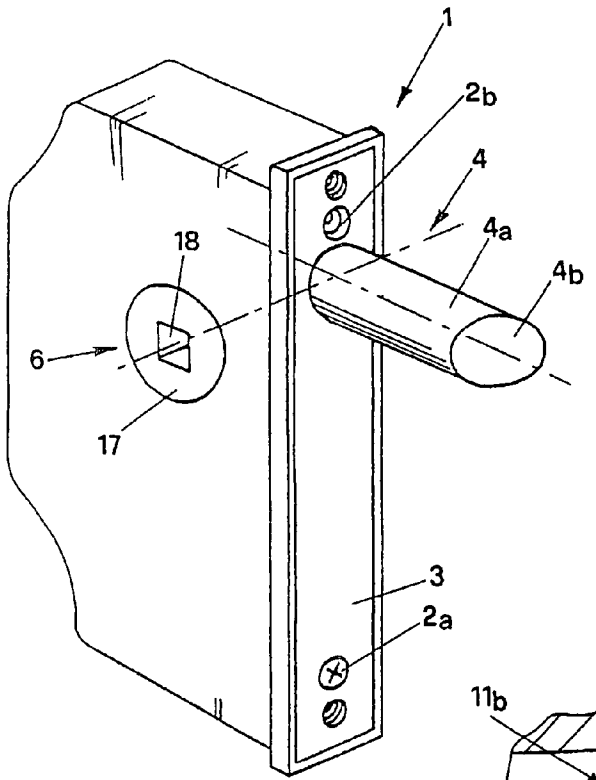
FIG. 1 is an isometric view of the lock of the invention.
Figure 3:
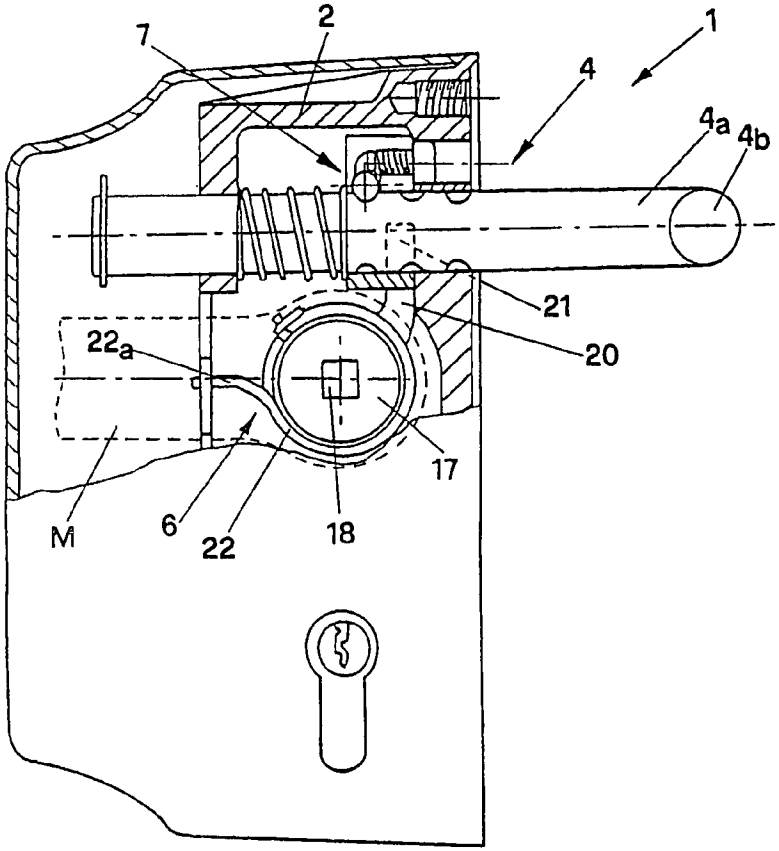
FIG. 3 is a partial longitudinal section of the lock of FIG. 1.

The lock of the invention is shown in the isometric view of FIG. 1 and in the partial sectional view of FIG. 3 where it is generally indicated with reference numeral 1.

One can see that the lock comprises a box body 2 to which a faceplate 3 is engaged preferably but not necessarily through screws 2*a*. The box body 2 and the faceplate 3 have coaxial and aligned holes through which a latch generally indicated with numeral 4 sliding, the protruding portion 4*a* of the latch being provided with a beveled end 4*b*.

Inside the box body two elastic means are associated to the latch 4 consisting of a helical spring 5 coaxially arranged around the latch, said spring keeping the portion 4*a* normally protruding from the faceplate 3.

Inside the box body 2 moving means generally indicated with numeral 6 are provided, said means being associated to a handle M that can be actuated by the user to move the latch 4.

Still inside the box body 2 there is also a mechanical adjustment unit generally indicated with numeral 7, to change the length of the protruding portion 4*a* of the latch 4 relative to the faceplate 3 and therefore penetration of the latch in the striker of the frame.

According to the invention said mechanical adjustment unit 7 comprises:

- a plurality of seats 8 made in the latch 4;
- at least a contrast element in the form of a cylindrical pin 9 adapted to be received in each of said seats 8; and
- adjustment means 10 accessible from outside and acting on the pin 9 to constrain it in the corresponding seat 8 or release it from said seat.

Figure 4:
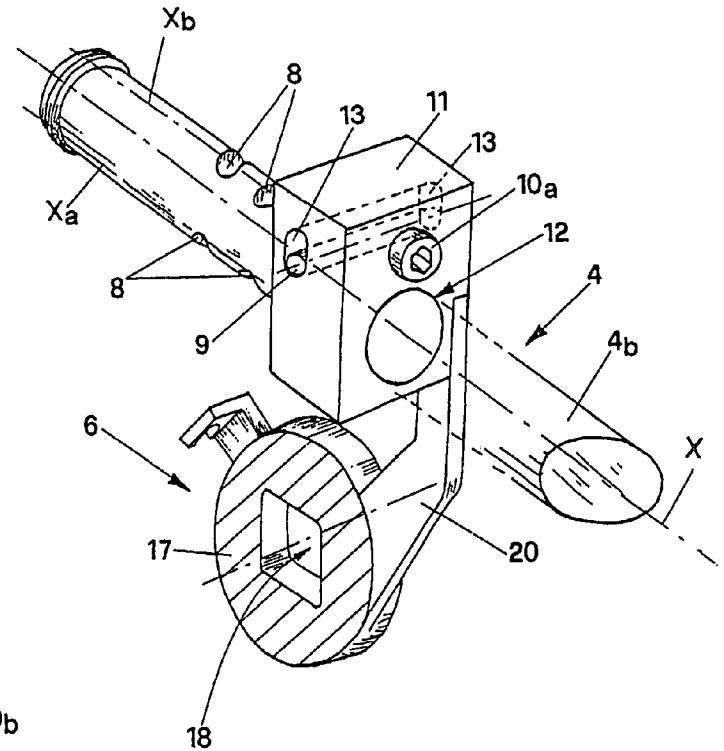
FIG. 4 is an isometric view of details of the lock shown in FIG. 3.
Figure 2:
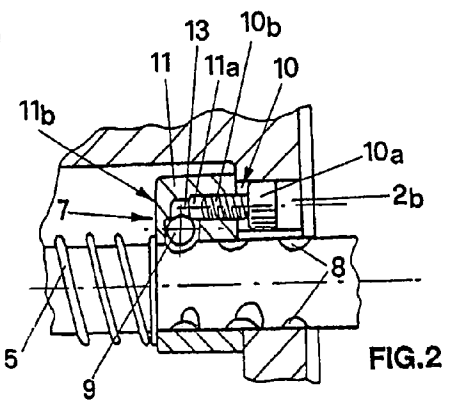
FIG. 2 is a sectional view of a detail of the FIG. 1.

More particularly with reference to FIGS. 2 and 4 the pin 9 and the adjustment means 10 accessible from outside, are arranged in a lodging block 11 arranged inside the box body 2, and provided with a through hole 12 slidingly receiving the latch 4.

The lodging block 11 preferably but not necessarily has a parallelepipedal shape and is provided with and elongated slot 13 receiving the cylindrical pin 9.

As to the adjustment means, they comprise a screw 10 whose head 10*a* is arranged in a through hole 2*b*, a part of which is made in the box body 2 and another part in the faceplate 3, while the threaded stem 10*b* of the screw is coupled in a threaded through hole 11*a* made in the lodge block 11.

On the lodge block 11 and inside the box body 2 there is a striker wall 11*b* against which the end of the elastic means causing the sliding motion of the latch 4 to be yielding is leaning. Said elastic means consist of a helical spring 5 coaxially arranged outside the latch 4 and contained between said striker wall 11*b* of the lodge block 11 and the box body 2.

As to the seats 8 made in the latch 4, one can see in FIG. 4 that they consist of a plurality of crescent like recesses arranged transversally to the latch and aligned along two directions Xa, Xb parallel to each other and to the longitudinal axis X of the latch 4.

The cylindrical pin 9 forming a contrast element, may be received in any of said seats 8, in which it is held by the contact with the threaded stem 10*b* of the screw 10.

With reference now to the moving means for the latch 4, generally indicated with numeral 6, one can see that they comprise an annular body 17 pivotally constrained inside the box body 2, in which a handle M to be actuated by the user is coupled through a square hole 18.

The annular body 17 is provided with a projection 20 inserted in a corresponding seat 21 made in the latch 4.

A spring 22 circumferentially wound to the annular body 17 and arranged with an end 22*a* against the box body 2, makes rotation of the handle M elastic so as to return the handle to the normal position shown in FIG. 3 with the portion 4*a* of the latch 4 protruding after each operation.

In operation starting from the condition of door closed, by rotating the handle M, retraction of the protruding portion 4*a* of the latch 4 into the box body 2 is caused, allowing opening of the door.

On release of the handle, the elastic return of the helical spring 5 causes the latch 4 to return to the starting position, with the portion 4*a* protruding from the box body 2 as shown in FIG. 1 or 3.

By an intervention on the adjustment means it is possible to rotate the latch 4 180° around its longitudinal axis X to change orientation of the end 4*b* of the protruding portion 4*a* or to adjust the length of said protruding portion 4*a* relative to faceplate 3.

Indeed when the lock is arranged in the configuration shown in FIG. 3, the latch 4 is constrained to the lodge block 11 because the threaded stem 10*b* of the screw 10 keeps the cylindrical pin 9 inside the corresponding recess 8.

By acting on the head 10*a* of screw 10 from outside through hole 2*b* and by a screwdriver or similar tool, the screw 10 is unscrewed as shown in FIG. 2 so as to release the pin 9 that can move inside the elongated slot 13 as it is not constrained in the corresponding seat 8.

This allows to rotate the latch 4 of 180° turning its shaped end 4*b* to the frame with which it must be coupled.

Moreover, when the pin 9 is released, it is also possible to slide axially the latch 4 so as to change the length of its protruding portion 4*a* relative to the faceplate 3.

When the required position is reached, the screw 10 is again tightened until the pin 9 is again blocked in another seat 8 in a condition similar to the that shown in FIG. 3.

According to the foregoing description it is clear that the lock of the invention attains all the intended objects.

Indeed, the objects to be able to adjust the protrusion of the latch and orientation of its shaped end are attained through simple operations that are carried out from outside without disassembling the lock from the door, entrance or gate to which it is applied.

Moreover, simplicity of operations is such that they can be carried out also by unskilled workers.

Figure 5:
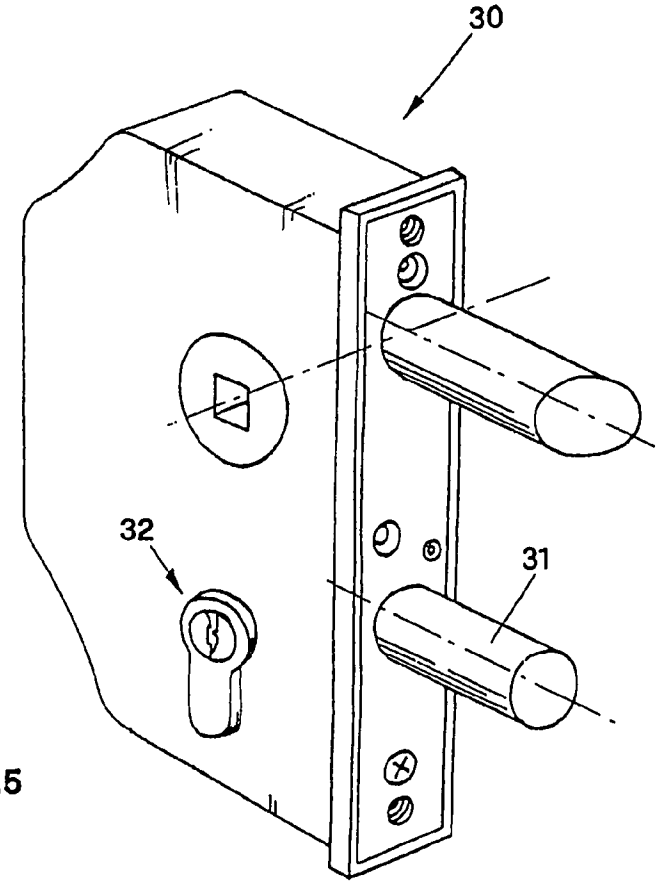
FIG. 5 is a constructional modification of the lock of the invention.

A constructional modification of the invention is shown in FIG. 5 and relates to a lock generally indicated with 30 which is different from the above described lock for the addition of a bolt 31 of a kind known per se associated to key means 32 to be actuated by the user.

In the constructional stage many modifications may be made to the locks of the invention in order to improve its operation or to make easier its construction.

When said modifications or variations neither described nor illustrated in the drawings fall within the scope of the appended claims, they should be considered to be covered by the present patent.

The invention claimed is:

1. A lock (1, 30) of the kind comprising:

a box body (2)

a faceplate (3) engaged to said box body;

a latch (4) co-operating with elastic means (5) adapted to keep the latch normally protruding from said faceplate (3), a plurality of seats (8) being made in the latch (4);

moving means (6) engaged to a handle (M) to be actuated by the user;

a mechanical adjustment unit (7) inside said box body (2) adapted to change a length of a portion (4*a*) of said latch (4) protruding from said faceplate (3);

said adjustment unit having an elongated slot extending therethrough with a cylindrical pin movably engaged therein and adapted to be selectively received in one of said seats (8);

said mechanical adjustment unit (7) having adjustment apparatus (10) accessible from outside the box body to fix or release said pin (9) when in said one of said seats (8) so that when the pin (9) is released, the latch (4) is slidable axially to change the length of the protruding portion (4*a*) relative to the faceplate (3) and when the pin (9) is fixed in said one of said seats (8) the position of the latch (4) is fixed.

2. The lock (1, 30) according to claim 1 wherein said pin (9) and said adjustment unit is arranged in a lodge block (11) arranged inside said box body (2) and provided with a through hole (12) slidingly receiving said latch (4).

3. The lock (1, 30) according to claim 2 wherein said elastic means consists of a helical spring (5) coaxially arranged around said latch (4) and between said lodge block (11) and said box body (2).

4. The lock (1, 30) according to claim 2 wherein said adjustment apparatus comprises a screw (10) having an actuation head (10*a*) arranged in a through hole (2*b*) communicating with the outside and made part in said box body (2) and part in said faceplate (3), and a threaded stem (10*b*) coupled in a threaded adjustment hole (11*a*) made in said lodge block (11) and co-operating by contact with said pin (9).

5. The lock (1, 30) according to claim 1 wherein said pin is arranged with its longitudinal axis placed transversely to the longitudinal axis (X) of said latch (4).

6. The latch (1, 30) according to claim 1 wherein said seats consist of a plurality of crescent like recesses (8) arranged transversally to said latch (4).

7. The lock (1, 30) according to claim 6 wherein said recesses (8) are aligned to each other along two rectilinear directions (Xa, Xb) parallel to each other and to the longitudinal axis (X) of said latch (4) and are offset at 180°.

8. The lock (1, 30) according to claim 1 wherein said moving means (6) are provided which comprise an annular body (17) pivotally constrained inside said box body (2) and coupled to said handle (M), said annular body (17) being provided with a protrusion (20) inserted into a corresponding seat (21) made in said latch (4).

9. The lock (1, 30) according to claim 8 wherein a spring (22) opposing said box body (2) is associated to said annular body (17) so as to make elastic rotation of said handle (M).

10. The lock (30) according to claim 1 further comprising a bolt (31) associated to key means (32) to be actuated by the user.

11. A lock (1, 30) of the kind comprising:

a box body (2)

a faceplate (3) engaged to said box body;

a latch (4) co-operating with elastic means (5) adapted to keep the latch normally protruding from said faceplate (3), a plurality of seats (8) being made in the latch (4);

moving means (6) engaged to a handle (M) to be actuated by the user;

a mechanical adjustment unit (7) inside said box body (2) adapted to change a length of a portion (4*a*) of said latch (4) protruding from said faceplate (3);

said adjustment unit having an elongated slot extending therethrough with a cylindrical pin movably engaged therein and adapted to be selectively received in one of said seats (8);

said mechanical adjustment unit (7) having adjustment apparatus (10) accessible from outside the box body to fix or release said pin (9) when in said one of said seats (8) so that when the pin (9) is released, the latch (4) is slidable axially to change the length of the protruding portion (4*a*) relative to the faceplate (3) and when the pin (9) is fixed in said one of said seats (8) the position of the latch (4) is fixed;

wherein said pin (9) and said adjustment apparatus is arranged in a lodge block (11) arranged inside said box body (2) and provided with a through hole (12) slidingly receiving said latch (4); and wherein said adjustment apparatus comprises a screw (10) having an actuation head (1O*a*) arranged in a through hole (2*b*) communicating with the outside and made part in said box body (2) and part in said faceplate (3), and a threaded stem (10*b*) coupled in a threaded adjustment hole (11*a*) made in said lodge block (11) and co-operating by contact with said pin (9).

* * * * *